US010124930B2

(12) United States Patent
Sessions

(10) Patent No.: US 10,124,930 B2
(45) Date of Patent: Nov. 13, 2018

(54) PULL-OUT EXPANDABLE CONTRACTIBLE POUR SPOUT CARTRIDGE INSERT FOR LIQUID CONTAINER OPENINGS

(71) Applicant: Randy J. Sessions, Riverton, UT (US)

(72) Inventor: Randy J. Sessions, Riverton, UT (US)

(73) Assignee: SESSIONS/PAINTER, LLC, Riverton, UT (US)

( * ) Notice: Subject to any disclaimer, the term of this patent is extended or adjusted under 35 U.S.C. 154(b) by 0 days.

(21) Appl. No.: 15/644,155

(22) Filed: Jul. 7, 2017

(65) Prior Publication Data

US 2017/0305604 A1 Oct. 26, 2017

Related U.S. Application Data

(63) Continuation-in-part of application No. 14/701,846, filed on May 1, 2015.

(60) Provisional application No. 62/002,845, filed on May 24, 2014.

(51) Int. Cl.
*B65D 25/44* (2006.01)
*B65D 47/06* (2006.01)

(52) U.S. Cl.
CPC ..... *B65D 25/44* (2013.01); *B65D 47/063* (2013.01)

(58) Field of Classification Search
CPC ..... B67D 3/0051; B67D 7/002; B67D 7/42; B67D 7/005; B65D 25/44; B65D 47/063; B65D 47/061; B65D 47/068; B65D 47/06; B65D 47/065; B65D 47/066; B65D 47/122; B65D 2547/06; B65D 2547/063
See application file for complete search history.

(56) References Cited

U.S. PATENT DOCUMENTS 1,056,790 A * 3/1913 Herblin ..... B65D 47/061 222/539
1,804,627 A 5/1931 Lukenbill
1,938,479 A * 12/1933 Baker, Jr. ..... B65D 47/061 222/539
2,163,952 A * 6/1939 Leighton ..... B65D 47/061 220/265
2,772,822 A * 12/1956 Phillips ..... B65D 47/061 222/520
2,804,242 A 8/1957 Borah
2,895,654 A * 7/1959 Rieke ..... B65D 47/063 220/212.5
2,898,018 A * 8/1959 Borah ..... B65D 47/063 222/460
2,993,628 A * 7/1961 Borah ..... B65D 47/063 222/530
3,093,273 A * 6/1963 Borah ..... B65D 47/063 222/498
3,204,827 A * 9/1965 Krautkramer ..... B65D 47/063 222/143
3,250,428 A * 5/1966 Rieke ..... B65D 47/063 222/538

(Continued)

*Primary Examiner* — Patrick M Buechner
(74) *Attorney, Agent, or Firm* — Marcus G. Theodore

(57) ABSTRACT

An expandable contractible pour spout cap insert adapted to secure to openings of fluid containers for motor oils, transmission fluids, cooking oils, liquors, etc. with an extendable corrugated hose in communication with the interior of the container and an open pouring end, which extends in a pour position, and collapses back into the pour spout cap insert in a storage position.

5 Claims, 6 Drawing Sheets

(56) References Cited

U.S. PATENT DOCUMENTS 3,298,577 A * 1/1967 Chlystun ..... B65D 25/44 215/253
3,856,187 A * 12/1974 Chlystun ..... B65D 47/063 222/529
4,022,357 A * 5/1977 Dwinell ..... B65D 47/061 222/537
4,073,413 A * 2/1978 Tabler ..... B65D 47/063 222/529
4,111,331 A * 9/1978 Summers ..... B65D 47/063 215/274
4,219,137 A * 8/1980 Hutchens ..... B65D 25/44 222/462
4,256,154 A 3/1981 Black
4,311,259 A * 1/1982 Babiol ..... B65D 25/44 220/285
4,422,563 A * 12/1983 Babiol ..... B65D 47/063 222/153.09
4,560,081 A * 12/1985 Adams ..... B65D 47/063 220/260
4,602,728 A * 7/1986 Ha ..... B65D 25/44 222/528
4,632,282 A * 12/1986 Nagashima ..... B65D 47/122 220/270
4,726,491 A * 2/1988 Moon ..... B65D 25/44 222/1
4,817,832 A 4/1989 Nagy
4,893,734 A * 1/1990 Chlystun ..... B65D 47/0838 215/216
5,004,126 A * 4/1991 Klesius ..... B65D 47/063 215/256
5,088,632 A * 2/1992 Odet ..... B65D 47/063 222/529
5,577,643 A * 11/1996 Stolz ..... B65D 5/746 222/529
5,601,215 A * 2/1997 Stolz ..... B65D 5/746 222/529
5,641,099 A * 6/1997 McLelland ..... B65D 47/063 222/530
5,941,425 A * 8/1999 Stolz ..... B65D 47/063 222/153.14
6,112,949 A * 9/2000 Rhodes ..... B65D 47/061 222/153.02
7,624,899 B1 * 12/2009 Barksdale ..... B65D 51/18 215/43
8,430,279 B2 4/2013 Rigel
2004/0188474 A1 9/2004 Johnston Wills
2011/0084090 A1 * 4/2011 MacDougall ..... B65D 25/44 222/1
2012/0085793 A1 * 4/2012 Selina ..... B65D 25/44 222/529

* cited by examiner

PULL-OUT EXPANDABLE CONTRACTIBLE POUR SPOUT CARTRIDGE INSERT FOR LIQUID CONTAINER OPENINGS

RELATED APPLICATIONS

This patent application is a continuation-in-part of U.S. patent application Ser. No. 14/701,846 filed May 1, 2017 entitled "Internal Pull-Out Expandable Contractible Pour Spout Cap for Liquid Container Openings, which is dependent upon U.S. Provisional Patent Application Ser. No. 62/002,845 filed May 24, 2014 entitled "Internal Pull-Out Expandable Contractible Pour Spout Insert for Containers".

BACKGROUND OF THE INVENTION

Field

This invention pertains to container pour spouts. More particularly it relates to an internally mounted expandable contractible pour spout insert for containers with pour openings for motor oils, transmission fluids, cooking oils, liquids, liquors, etc.

Statement of the Art

A variety of pour spouts and funnels for pouring liquids from containers are known. Lukenbill, U.S. Pat. No. 1,804,627 issued May 12, 1931 discloses a sanitary pouring cap with accordion extending and retracting pour spout. Borah, U.S. Pat. No. 3,093,273 issued Jun. 11, 1963 discloses a retractable and extendable container spout. Nagy, U.S. Pat. No. 4,817,832 issued Apr. 4, 1989 discloses a telescoping nozzle assembly adapted to be secure to the opening of container to facilitate pouring of container fluid. Johnston Wills, Pub. No. US 2004/0188474 published Sep. 30, 2004 discloses a collapsible/flexible pouring attachment to pour liquid from a plastic bottle and/or container. Borah, U.S. Pat. No. 2,804,242 issued Aug. 27, 1957 discloses a container spout and gasket combination. Rigel, U.S. Pat. No. 8,430,279 issued Apr. 30, 2013 discloses a bottle accessory for application with a cap to the neck of a bottle, particularly useful for attaching a retractable spout to a bottle.

Cited for general interest is Black, U.S. Pat. No. 4,256,154 issued Mar. 17, 1981 disclosing a bottle with retractable funnel top.

Other devices are secured to the opening of a liquid container to assist in pouring therefore. Motor oil and transmission fluid pour spouts typically have a fixed or flexible hose with mounting adapted to screw onto the exterior threads of an opened container. Cooking oils have a spout with mountings adapted to insert into the opening of a container opening. Funnels come in a variety of shapes and designs to contain and direct fluids into a desired bottle or container.

Most of these pour spouts and funnels are combination cap/pour spouts that are difficult to construct, produce, or to secure to the opening of a liquid container. Other separate pour spout and funnel devices are required to be applied after a fluid container is opened.

There thus remains a need for an improved pour spout insert with a flexible accordion spout removably affixed to a container opening to eliminate the need for finding a funnel or other spouts to aid in pouring. The apparatus described below provides such an invention.

SUMMARY OF THE INVENTION

The present invention comprises an expandable contractible pour spout cap insert adapted to removably secure to openings of fluid containers. It comprises a pull cap with a finger pull ring and a threaded pull cap base attached to a flexible telescoping accordion pour spout with a first threaded end adapted to removably secure to the threaded pull cap base, and a second end with side walls defining a channel, when mounted in communication with fluid container openings. The pull cap base is removably secured to the threaded first end of the accordion pour spout to close its channel in a storage mode. The pull cap base is then removed after the pull cap extends and unblocks the pour spout channel for pouring in a pouring mode.

A flexible extension/inversion plastic diaphragm with a top is affixed to the second end of the telescoping accordion pour spout with a bottom structured, when secured, to seal to openings of a fluid container. The plastic diaphragm is structured to extend beyond the opening of the fluid container to expose the telescoping pour spout for pouring in an extended mode. The telescoping pour spout is then collapsed against the inverted plastic diaphragm to store therein. The collapsed pour spout within the inverted plastic diaphragm fits within an opening of a fluid container in a storage mode.

A pour spout cap base structured as a threaded nut fitting with an opening structured to surround and secure the bottom of the extension/inversion plastic diaphragm secures the plastic diaphragm and pour spout to removably seal to threaded openings of fluid containers to align with the channel of the pour spout cap cartridge insert.

The bottom of the plastic diaphragm is structured as a flanged gasket to secure about the opening of the fluid container to seal as a compression fitting when the pull cap threaded base is screwed onto the container threaded opening to prevent spills. The pour spout cap cartridge insert threaded nut fitting opening has internal threads to secure to corresponding threaded external openings of fluid containers in one embodiment.

In another embodiment, the pour spout cap base threaded nut fitting could have external threads to secure to corresponding threaded internal openings of fluid containers.

For pouring, the pull cap is pulled and removed from its pour spout cap base extending the pour spout. The pull cap is then removed from the accordion pour spout first end for pouring in a pouring mode. After pouring, the pull cap is replaced back onto the first end of the telescoping according pour spout to close the same for storing liquids in the fluid container in a storage mode. The telescoping accordion pour spout may or may not be compressed and secured back into the pour spout plastic diaphragm and its pour spout cap base for storage depending upon the preference of a user.

The pour spout cap base is structured to affix to and form a seal with openings of fluid containers. The pour spout cap base usually is threaded internally to secure to corresponding threads of the opening of the fluid container.

The pull cap may be structured to collapse into place on the pour spout cap base when not in use. It is then extended when the pour spout is to be used. To aid in its removal, the pull cap may include a retractable finger pull ring.

In one variation, the bottom of the flexible extension/inversion plastic diaphragm is structured as a flanged gasket to secure about the opening of the fluid container when the pull cap threaded base is screwed onto the container threaded opening.

The pour spout bottom, telescoping accordion pour spout and extension/inversion plastic diaphragm may be constructed as one piece with the fluid container. This embodiment has the pour spout cap then threadably attached to the end of the pour spout opening to removably seal the same.

The expandable contractible pour spout cap insert is a separate cartridge insert structured to fit and secure to the opening of the neck of a fluid container forming a fluid tight seal in communication with the interior of the fluid container neck when secured therein as described above.

In one embodiment, the cartridge insert is constructed of a universal size to fit various sized containers having standard threaded neck openings. Other cartridge insert configurations snap fit to the container neck openings with fluid type joints wherein the cartridge insert secures within or without the container pour opening to form fluid sealed joints.

The flex hose accordion tubing is expandable and collapsible made of a corrugated thin plastic. The corrugated shaped allows it to bend in a desired direction when extended for pouring. It then collapses back into the cartridge insert for storage.

The pour spout cap cartridge insert may include a storage cap with sidewalls sized and structured to encase the collapsed accordion pour spout within the inverted extension/inversion plastic diaphragm. The sidewalls have edges adapted to removably secure to the pour spout threaded base exterior.

The storage cap sidewalls edges are also structured to removably secure to corresponding structure of the pour spout threaded base exterior.

The invention thus provides a simple cost effective pour spout cartridge that can be manufactured in different sizes to adapt to most containers to provide a container with a built in pour spout. This eliminates the need for funnels and additional attachable spouts, which are more expensive. It provides a container with a flexible plastic spout that sits inside the cartridge with a pull top cap that is disposable or reusable.

DESCRIPTION OF THE ILLUSTRATED EMBODIMENTS

Figure 1:
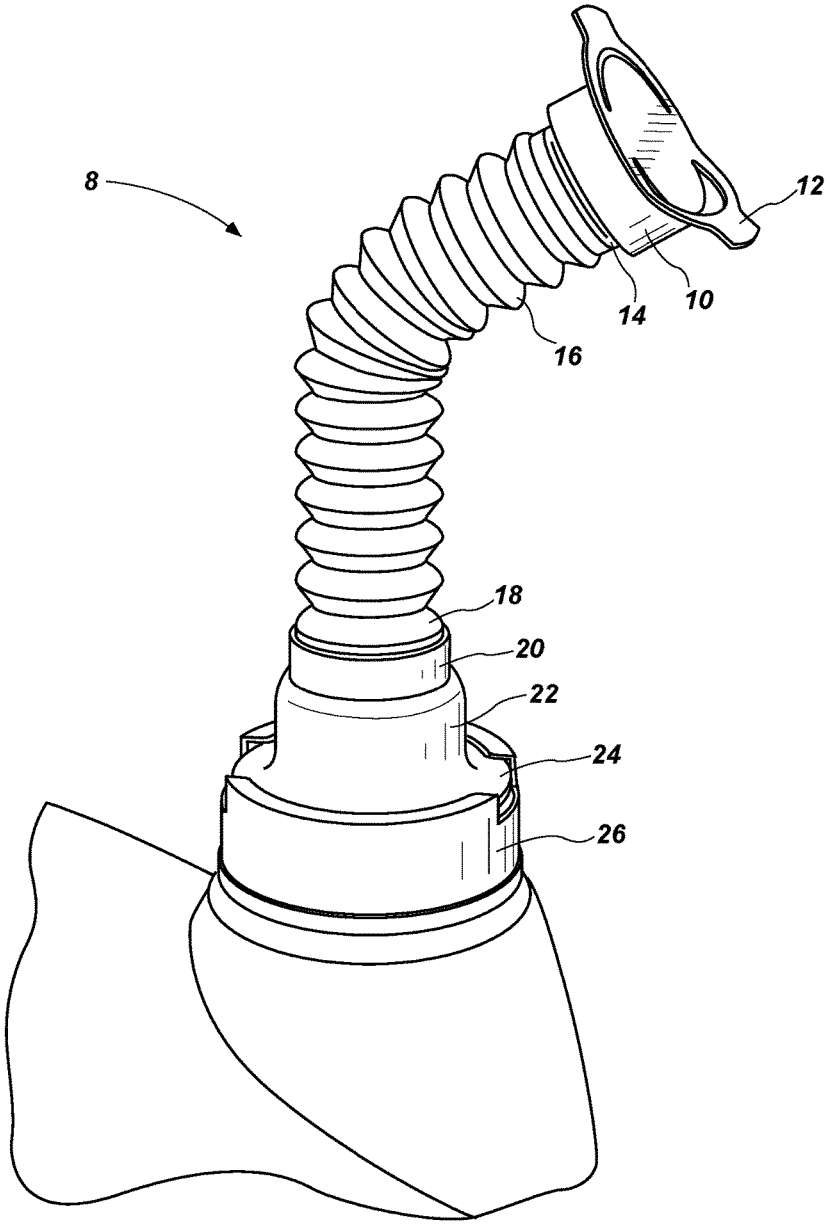
FIG. 1 illustrates a perspective view of the extended pour spout cap insert affixed to the neck of a fluid container.

FIG. 1 illustrates a perspective view of the extended pour spout cap insert 8 affixed to the neck opening of a fluid container. The pour spout cap 10 has a pull ring 12. The pour spout cap 10 is attached to a threaded end 14 of a flexible extendable/collapsible accordion hose 16 to extend the same for pouring. The other end 18 of the flexible accordion hose 16 is affixed to the top 20 of a flexible extension/inversion plastic diaphragm 22 forming a continuous channel in communication with the interior of the container, when mounted to the neck opening of a fluid container by the pour spout cap base 26. The bottom 24 of the flexible extension/inversion plastic diaphragm 22 is flanged, and secured by the pour spout cap base 26 to the neck opening of the fluid container forming a gasket type fluid tight seal.

The pour spout cap 10 is unscrewed from the threaded end 14 of the flexible accordion hose 16 for pouring fluids from the container. After pouring, the pour spout cap 10 is screwed back on to store remaining fluids in the container.

Figure 2:
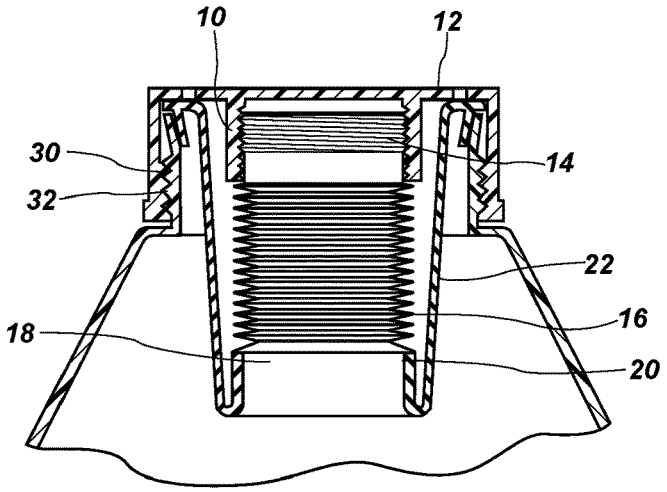
FIG. 2 illustrates a perspective view of the pour spout cap insert of FIG. 1 contracted.

FIG. 2 illustrates a perspective view of the pour spout cap insert 8 of FIG. 1 contracted to store within the neck opening of the container the compressed flexible accordion hose 16 supported by the inverted flexible extension/inversion plastic diaphragm 24, which is then secured within the neck opening of the fluid container by the pour spout cap base 26. A protective storage cap 28 shown in FIG. 3 with internal structure may be employed to secure the contracted assembly to the pour spout cap base 26. The pour spout cap base 26 has internal threads 30 adapted to secure to external threads 32 of the neck opening of a fluid container.

Figure 2A:
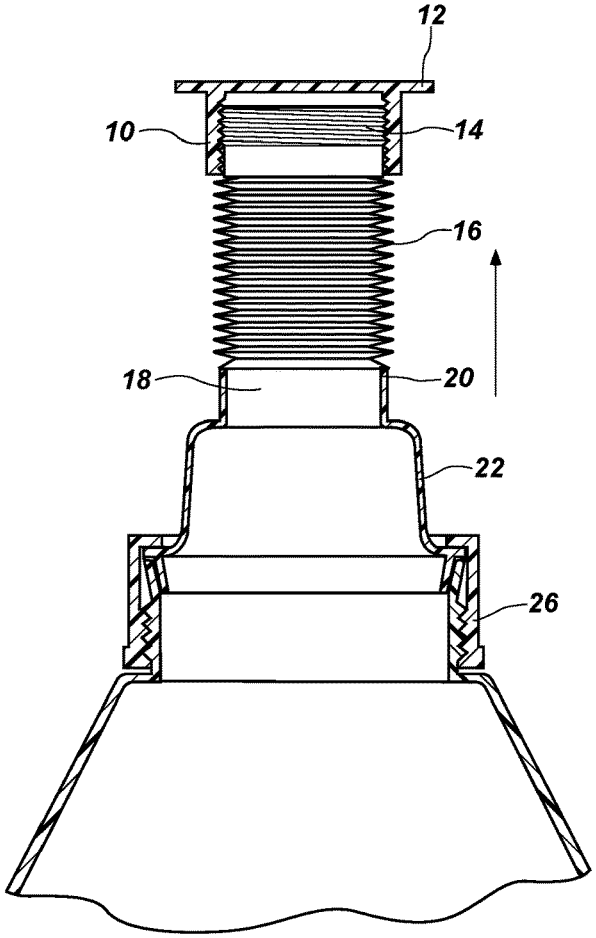
FIG. 2*a* illustrates the embodiment of FIG. 2 extended after the screw cap is pulled.

FIG. 2*a* illustrates the embodiment of FIG. 2 extended for pouring.

Figure 3:
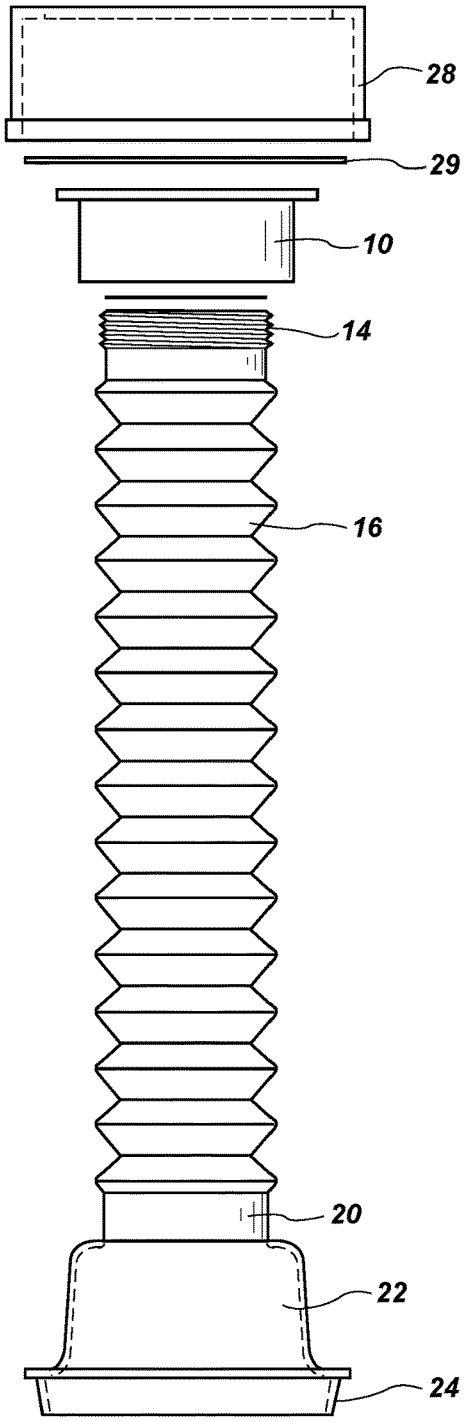
FIG. 3 illustrates the separate components of the pour spout cap insert 8 disassembled.

FIG. 3 illustrates the separate components of the pour spout cap insert 8 disassembled showing a storage screw cap 28 structured with a snap fitting base, which removably secures to the bottom 24 of the flexible extension/inversion plastic diaphragm 22. A removable tamper resistant seal 29 is located beneath the bottom of the storage screw cap 28.

Figure 4:
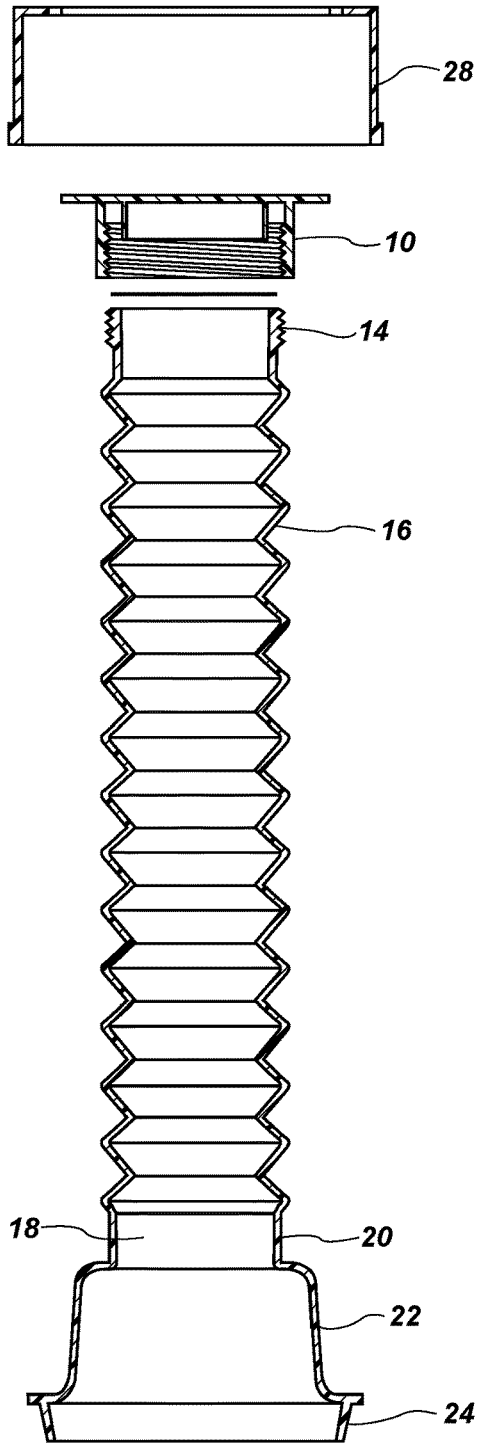
FIG. 4 illustrates a cross-sectional view of the pour spout cap insert 8 walls defining an internal channel.

FIG. 4 illustrates a cross-sectional view of the pour spout cap insert 8 interior where its components define an internal channel when mounted in communication with the interior of a fluid container.

Figure 5:
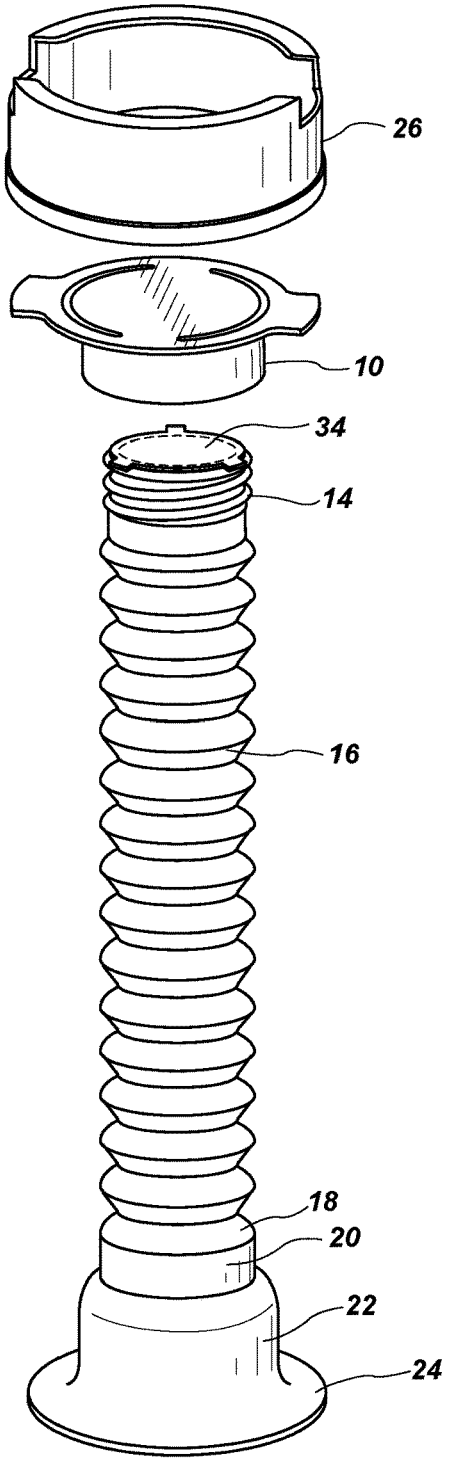
FIG. 5 illustrates a perspective exterior view of the pour spout cap insert of FIG. 4.

FIG. 5 illustrates a perspective exterior view of the pour spout cap insert 8 of FIG. 4. An optional removable seal 34 is shown on top of the threaded end 14 of the flexible accordion hose 16 to prevent product tampering.

Figure 6:
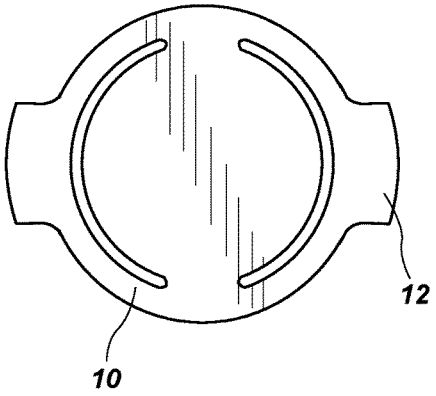
FIG. 6 illustrates a top view of the pour spout cap.

FIG. 6 illustrates a top view of the pour spout cap 10 showing the pull ring tab 12.

Figure 7:
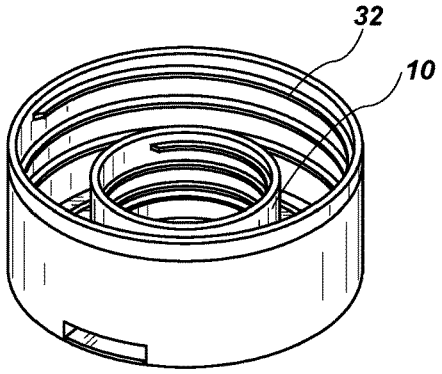
FIG. 7 illustrates a perspective view of the pour spout cap of FIG. 6 within a storage cap.

FIG. 7 illustrates a perspective bottom view of the pour spout cap 10 of FIG. 6. The pour spout cap 10 has internal threads 32, which removably secure to external threads 30 of a neck opening of a fluid container as shown in FIGS. 2 and 2*a*.

Figure 8:
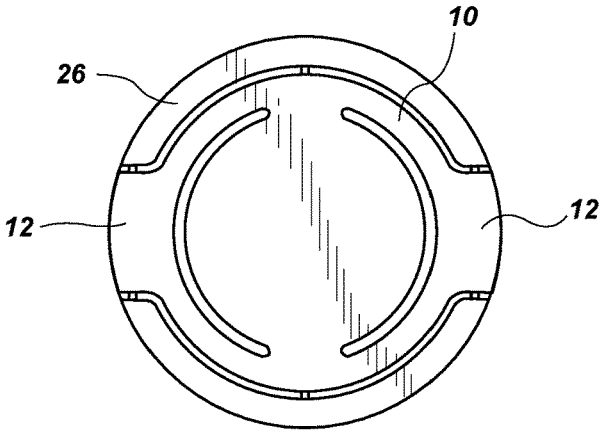
FIG. 8 illustrates a top view of a variation pour spout cap with finger pulls.

FIG. 8 illustrates a top view of another variation of a pour spout cap 10 with finger pulls 12.

The present invention may be embodied in other specific forms without departing from its structures, methods, or other essential characteristics as broadly described herein and claimed hereinafter. The described embodiments are to be considered in all respects only as illustrative, and not restrictive.

The scope of the invention is, therefore, indicated by the appended claims, rather than by the foregoing description. All changes that come within the meaning and range of equivalency of the claims are to be embraced within their scope.

I claim:

1. A screw-on expandable contractible pour spout cap cartridge insert adapted to removably secure to a threaded pour opening of a fluid container, comprising:

a. a pull cap with a top and a finger pull ring affixed to the top, and a threaded pull cap base, wherein the pull cap finger pull ring extends beyond the top of the pull cap when pulled, b. a flexible telescoping accordion pour spout defining an interior channel with first and second open ends having a collapsed condition in a storage mode and an extended condition in a pouring mode with the first open end threaded to removably secure to the threaded pull cap base, and the second open end mounted in communication with the threaded pour opening of the fluid container, the threaded pull cap base removably secured to the threaded first open end of the flexible telescoping accordion pour spout to close its channel in the storage mode, and removed from the threaded pull cap base for the flexible telescoping accordion pour spout to pour in the pouring mode;

c. a flexible extension/eversion plastic diaphragm with a top affixed to the second open end of the flexible telescoping accordion pour spout and a bottom sized and structured, when secured, to seal about the threaded pour opening of the fluid container; said plastic diaphragm structured to extend beyond the threaded pour opening of the fluid container to release and allow extension of the flexible telescoping accordion pour spout for pouring in the pouring mode, and everted to store the flexible telescoping accordion pour spout in a collapsed condition within the threaded pour opening of the fluid container in a storage mode, and d. a pour spout threaded base structured as a threaded nut fitting with a base opening, which surrounds and secures the bottom of the extension/eversion plastic diaphragm to removably seal to the threaded pour opening of the fluid container to align the interior channel and second open end of the flexible telescoping accordion pour spout in communication with the fluid container pour opening of the fluid container; the pour spout threaded base having a notched top structured to accommodate the finger pull ring extension when collapsed against the pour spout threaded base.

2. The pour spout cap cartridge insert according to claim 1, wherein the bottom of the flexible extension/eversion plastic diaphragm is structured as a flanged gasket with a gasket opening sized to secure about and seal the gasket opening in communication with the pour opening of the fluid container.

3. The pour spout cap cartridge insert according to claim 1, wherein the pour spout threaded base has internal threads within its base opening structured to secure to corresponding external threads of the neck pour opening of the fluid container.

4. The pour spout cap cartridge insert according to claim 1, including a storage cap with sidewalls sized and structured to encase the telescoping accordion pour spout in collapsed condition within the extension/eversion plastic diaphragm with edges having structure to removably secure to the pour spout threaded base exterior.

5. The pour spout cap cartridge insert according to claim 4, wherein the storage cap with sidewalls includes structure which removably secures to corresponding structure on the pour spout threaded base exterior.

* * * * *